US005553528A

United States Patent [19]

Zoltner

[11] Patent Number: 5,553,528

[45] Date of Patent: Sep. 10, 1996

[54] SLITTER FOR A DESKTOP PAGE PRINTER

[75] Inventor: John D. Zoltner, Rochester, N.Y.

[73] Assignee: Xerox Corporation, Stamford, Conn.

[21] Appl. No.: 403,046

[22] Filed: Mar. 13, 1995

[51] Int. Cl.[6] ..... B26D 7/06; B65H 39/10

[52] U.S. Cl. ..... 83/443; 83/446; 271/303; 101/232

[58] Field of Search ..... 83/343, 346, 407, 83/418, 423, 443, 649, 106, 446; 101/232, 236, 237, 238, 241; 271/213, 303

[56] References Cited

U.S. PATENT DOCUMENTS

| | | | |
|---|---|---|---|
| 244,845 | 7/1881 | Bowles . | |
| 325,812 | 9/1885 | Bridgman . | |
| 391,750 | 10/1888 | Koebel . | |
| 393,535 | 11/1888 | Browne . | |
| 416,829 | 12/1889 | Crosby . | |
| 3,122,040 | 2/1964 | Bishop . | |
| 4,083,635 | 4/1978 | Reed, Jr. | 355/77 |
| 4,344,610 | 8/1982 | Jeschke et al. | 83/346 X |
| 4,559,855 | 12/1985 | Schieck | 83/425.3 |
| 4,882,004 | 11/1989 | Watson | 83/343 X |
| 4,941,377 | 7/1990 | Ishihara et al. | 83/423 |
| 4,945,390 | 7/1990 | Hasegawa et al. | 271/303 X |
| 4,994,861 | 2/1991 | Brandon et al. | 271/303 X |
| 5,049,929 | 9/1991 | Anderson et al. | 355/204 |
| 5,061,967 | 10/1991 | Isobe | 83/423 X |
| 5,168,311 | 12/1992 | Hino | 355/251 |
| 5,178,063 | 1/1993 | Wolfberg et al. | 101/76 |
| 5,201,517 | 4/1993 | Stemmle | 271/303 X |
| 5,313,256 | 5/1994 | Bov, Jr. et al. | 355/282 |
| 5,478,061 | 12/1995 | Murakami et al. | 271/303 X |

FOREIGN PATENT DOCUMENTS

| | | | |
|---|---|---|---|
| 0036266 | 2/1987 | Japan | 271/303 |
| 0051558 | 3/1987 | Japan | 271/303 |
| 402086542 | 3/1990 | Japan | 271/213 |
| 0221057 | 9/1990 | Japan | 271/303 |
| 404148760 | 5/1992 | Japan | 271/303 |

*Primary Examiner*—Rinaldi I. Rada
*Assistant Examiner*—Boyer Ashley
*Attorney, Agent, or Firm*—R. Hutter

[57] ABSTRACT

A desktop page printer, such as suitable for printing MICR images, includes a slitter for cutting page-size prints into check-size documents as the page prints are emitted from the printing machine. The slitter can be bypassed by the installation of a side output tray which causes the paper path to be diverted from the slitter.

6 Claims, 3 Drawing Sheets

SLITTER FOR A DESKTOP PAGE PRINTER

The present invention relates to a slitter suitable for cutting sheets which are output from a desktop-size printing machine.

Printing checks and other negotiable documents by electrophotographic means is becoming commonplace in the banking industry. By using an electrophotographic "laser printer" which is loaded with magnetically-permeable toner, fully usable checks can be printed at even the smallest branches or offices. The use of electrophotographic printers to create magnetic-ink-character-recognition (MICR) documents is well known as can be seen in, for example, U.S. Pat. No. 5,337,122, assigned to the assignee hereof.

Electronic printing of MICR documents facilitate the existence of highly distributed banking systems. Whereas previously checks had to be printed by relatively large-scale professional check printers, electrophotographic printing allows not only individual checks but entire checkbooks to be printed as needed at any number of individual bank branches within a large financial institution.

One common function carried out at bank branches is the opening of the new checking accounts, which typically include the distribution to the individual customer of a starter checkbook. A "starter checkbook" represents a small set of checks that the new account holder can use immediately. Before the availability of electronic printing of checks, it has been typical to provide the new customer with checks which do not have his name printed thereon. Such checks are often not accepted by various businesses, so it is desirable to be able to give a new account holder a fully usable checkbook immediately. Electrophotographic printing, which enables the instantaneous printing of checks with not only the correct MICR characters but also the new account holder's name and address thereon, therefore represents a major customer-service advantage for a bank.

From the standpoint of a manufacturer or purchaser of electrophotographic printing apparatus, it is desirable that a printing machine which is capable of printing MICR documents be as common as far as possible with standard designs of electrophotographic printers which are mass-produced at great economies of scale. Generally, commercially-available electrophotographic desk-top printers which are available at low cost are designed to output letter size pages. Of course, the typical check that a customer expects to see is much smaller than a full-page size, but rather from one-third to one-fourth the size of a full page. It would therefore be desirable to provide, as an add-on to a standard design of an electrophotographic desk-top printer, a device which can take full sheets output from the printer and cut them into normal-sized checks. One type of device which performs this cutting is called a "slitter."

A slitter is a device which accepts a sheet in a process direction, and cuts the sheet being fed therethrough in a direction parallel to the process direction. Various designs of such slitters are well-known in the art, and include such early patents as U.S. Pat. Nos. 244,845; 325,812; 391,750; 393,535; 416,826; and U.S. Pat. No. 3,122,040. U.S. Pat. No. 4,559,855, or U.S. Pat. No. 5,049,929, both assigned to the assignee hereof, can be seen as disclosing "dedicated" slitters, wherein the function of the slitter is built into a relatively large-scale machine.

Various applications of MICR characters in an electrophotographic context can be seen in U.S. Pat. Nos. 4,083,635; 5,168,311; and 5,178,063.

U.S. Pat. No. 5,313,256 discloses a device for embossing documents as they are emitted from the fuser of an electrophotographic printer. The sheets may be diverted as desired from the embossing roll by positioning a diverting member.

According to one aspect of the present invention, there is provided an apparatus for cutting sheets emitted in an output direction from an output slot of a printing machine. A slitter receives a sheet fed therethrough in a process direction and creates a cut in the sheet parallel to the process direction. A diverter is positionable in a first position to direct sheets emitted from the output slot through the slitter, and positionable in a second position to direct sheets emitted in the output direction from the output slot away from the slitter. A removable output tray includes a lug thereon, whereby installation of the output tray on the printing machine causes the lug to engage the diverter to position the diverter in one of the first position or the second position.

According to another aspect of the present invention, there is provided an apparatus for cutting sheets emitted in an output direction from an output slot of a printing machine. A slitter receives a sheet fed therethrough in a process direction and creates a cut in the sheet parallel to the process direction. A directing plate directs a sheet emitted in the output direction from the output slot through the slitter, the directing plate inverting the sheet as the sheet passes thereover.

Figure 1:
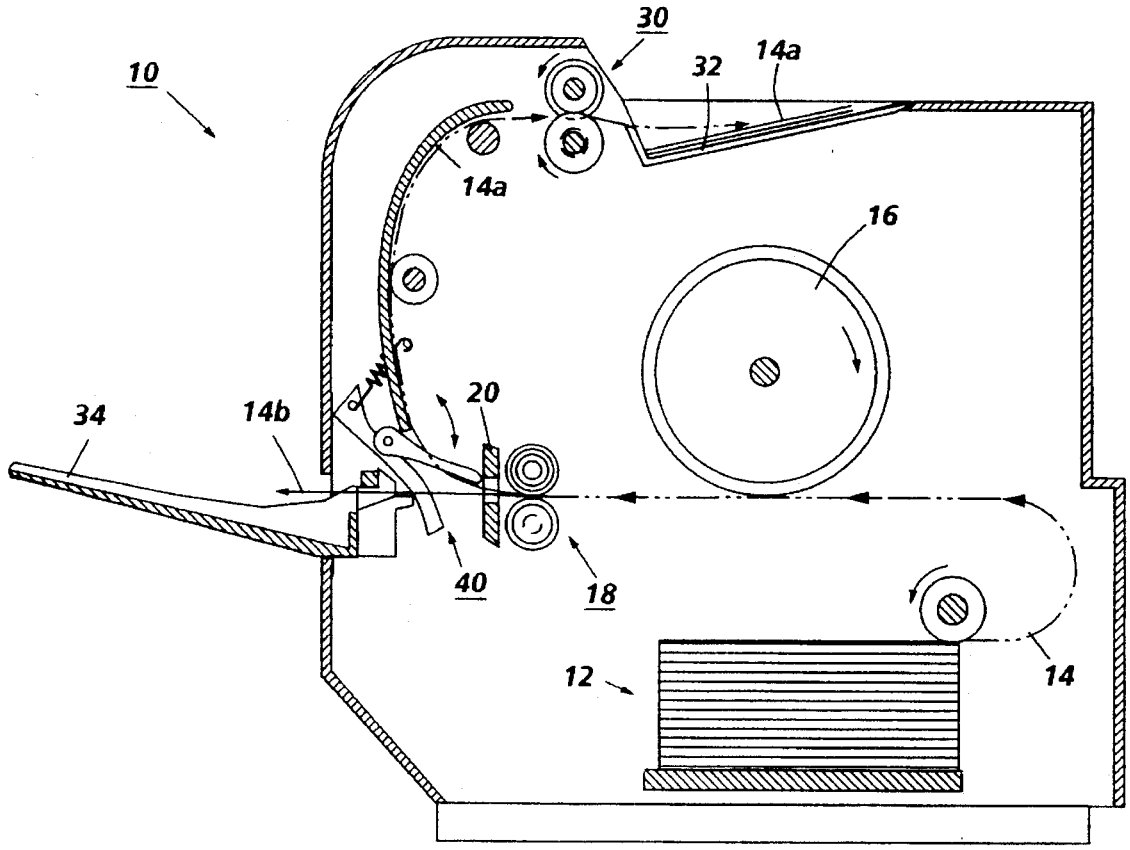
FIG. 1 is a simplified elevational view showing the basic portions of a desk-top printing machine, with the portions thereof relevant to the present invention.

FIG. 1 shows the basic elements of a desktop-size page printer of a general design known in the art, incorporating the slitter of the present invention. The printing machine, generally indicated as 10, includes, among other image-forming components, a paper supply 12, from which is drawn sheets one at a time for the creation of images thereon. A sheet withdrawn from paper supply 12 is passed through path 14 past an image forming device in the form of, for example, a photoreceptor 16, the function of which is familiar to those skilled in the art of electrophotography. It will be apparent that the photoreceptor 16 could be replaced by, for example, an ink-jet printhead or other image forming device which creates images on a selected sheet in accordance with digital image data fed thereto. Also, a "printing machine" as recited in the claims could also refer to a light-lens copier. As shown in FIG. 1, the sheets are passed through a fuser 18 useful in electrophotographic printing, and then pushed through what is generally referred to as an output slot 20, which is here intended to mean simply the point along the paper path 14 after which the printed sheet would generally be accessible to a user.

Also shown in the printing machine of FIG. 1 is a slitter generally indicated as 30. Once the desired image is formed on the page-size (such as 8½×11 inches) sheet, the sheet can be selectably cut into smaller sheets, such as to form individual checks, or to form any combination of checks and stubs, as would be desired by a user. As used in the specification and claims herein, the word "cutting" and the function of a "slitter" shall also be intended to include all variations of cutting, such as perforating to create separable portions of a sheet, or even embossing and debossing sheets passing therethrough. It will be noted that a portion of the paper path 14, here indicated as 14*a*, passes from output slot 20 and through the slitter 30, with the cut sheet being deposited in a top output tray 32. Alternately, sheets which are emitted from output slot 20 may, according to the present invention, be selectably diverted from slitter 30 and sent along path 14*b* to land in side output tray 34.

Figure 2:
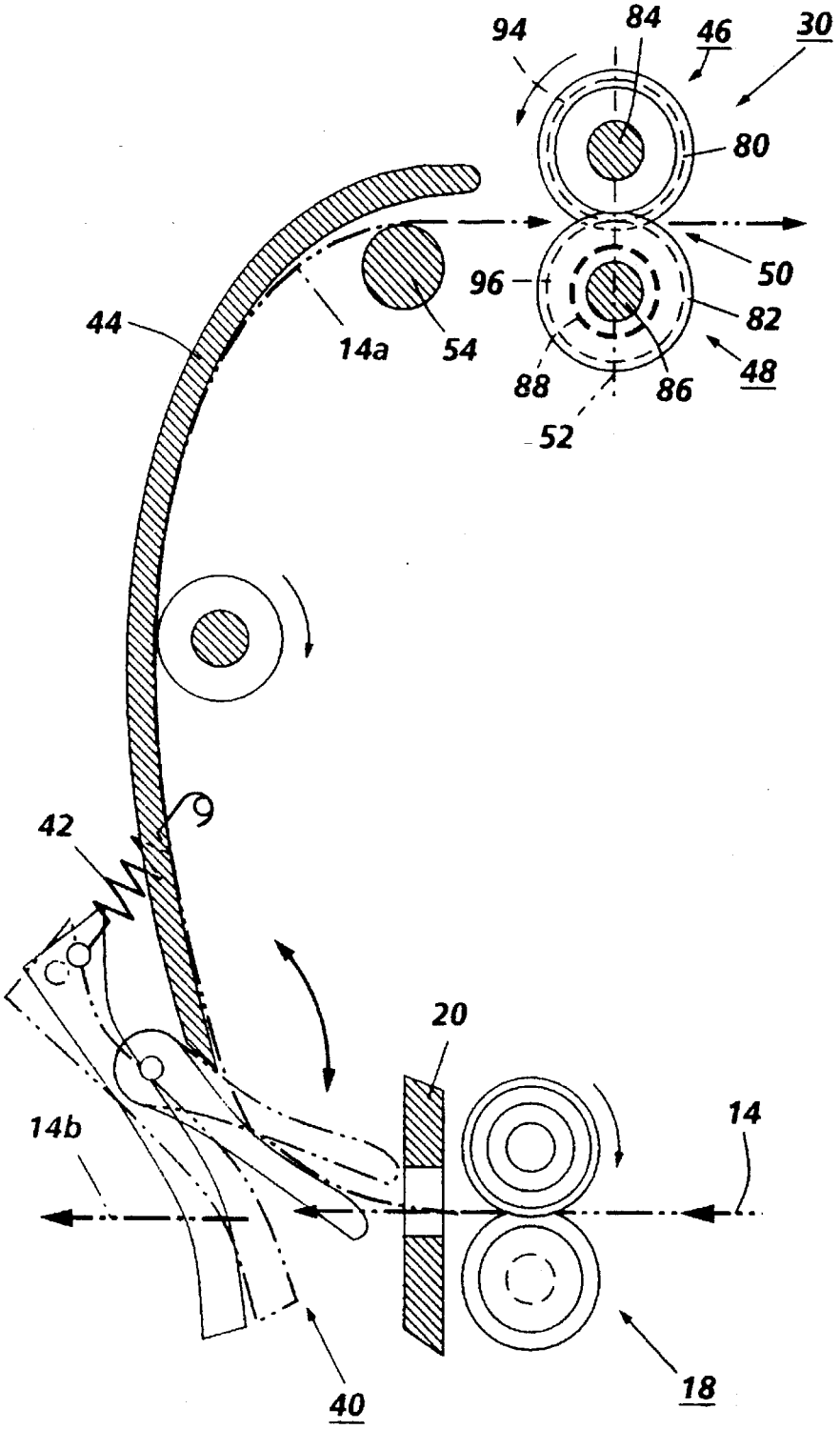
FIG. 2 is an elevational view showing, in detail, the operation of the slitter, directing plate, and inverter according to the present invention.

FIG. 2 is a detailed elevational view showing the general area where paper path 14 can be diverted to path 14*a* through slitter 30. Immediately downstream of output slot 20, there is provided a pivotably-mounted diverter 40, which is positionable in a first position which causes approaching sheets along paper path 14 to be diverted to paper path 14*a*, and also in a second position which causes approaching sheets along paper path 14 to be diverted away from slitter 30, in a manner in which will be described in detail below. According to the illustrated embodiment, diverter 40, which extends into the Figure along the width of the paper path, is springably mounted, such as by spring 42, to remain in the above-mentioned first position unless acted thereon by an outside member, as will be described below.

When the diverter 40 is urged by spring 42 to remain in the first position, a sheet coming through output slot 20 along paper path 14 is guided over the diverter 40, and caused to move along a directing plate here indicated as 44. Although directing plate 44 is here illustrated as a solid curved plate, it will be apparent that the function of directing plate could be performed by, for example, a set of narrow skids or fins, or a set of rollers, or a device applying an air pressure or suction to the sheet, all with the intended function of directing the sheet along path 14*a* to be properly fed into slitter 30; as used in the claims herein, the word "plate" shall apply to any structure which functions to direct a sheet moving through a path in a direction. The slitter generally indicated as 30 includes a first roll 46 and a second roll 48 forming a nip 50 therebetween. As illustrated in FIG. 2, different portions of rollers 46 and 48 may overlap slightly in a manner which is familiar in the art of slitters.

It will also be noted that the axes of rollers 46 and 48 together form an imaginary plane indicated as 52. It has been found, given the preferred design of a slitter which will be described in detail below, that the cleanest cuts created by a slitter occur when the sheet along paper path 14 is caused to enter the nip 50 at an angle which is as close as possible to being perpendicular to the plane 52 formed by the axes of rolls 46 and 48. In order to ensure this optimal feeding through nip 50, there is preferably provided a bar 54 generally between the directing plate 44 and the nip 50, over which the sheet along paper path 14*a* passes. It has been found, for clean slitting, that a sheet along paper path 14*a* should not be allowed to ride any more than necessary on the bottom roller 48 before the cutting process begins. By causing the sheet to ride over bar 54, the sheet generally will contact the two rolls 46 and 48 substantially at the same time, for the cleanest practical cut.

The position of diverter 40 in its second position is shown in phantom in FIG. 2. When the diverter 40 is placed in this second position, the sheet being emitted through output slot 20 will be directed under the diverter 40 as shown in FIG. 2, and pass along path 14*b* where it will not be cut by slitter 30. According to the present invention, when it is desired to position diverter 40 in the second position to prevent sheets emitted from output slot 20 from being fed to slitter 30, the proper positioning of diverter 40 in the second position can be performed by mere installation of a side output tray, such as shown as 34 in FIG. 1.

Figure 3:
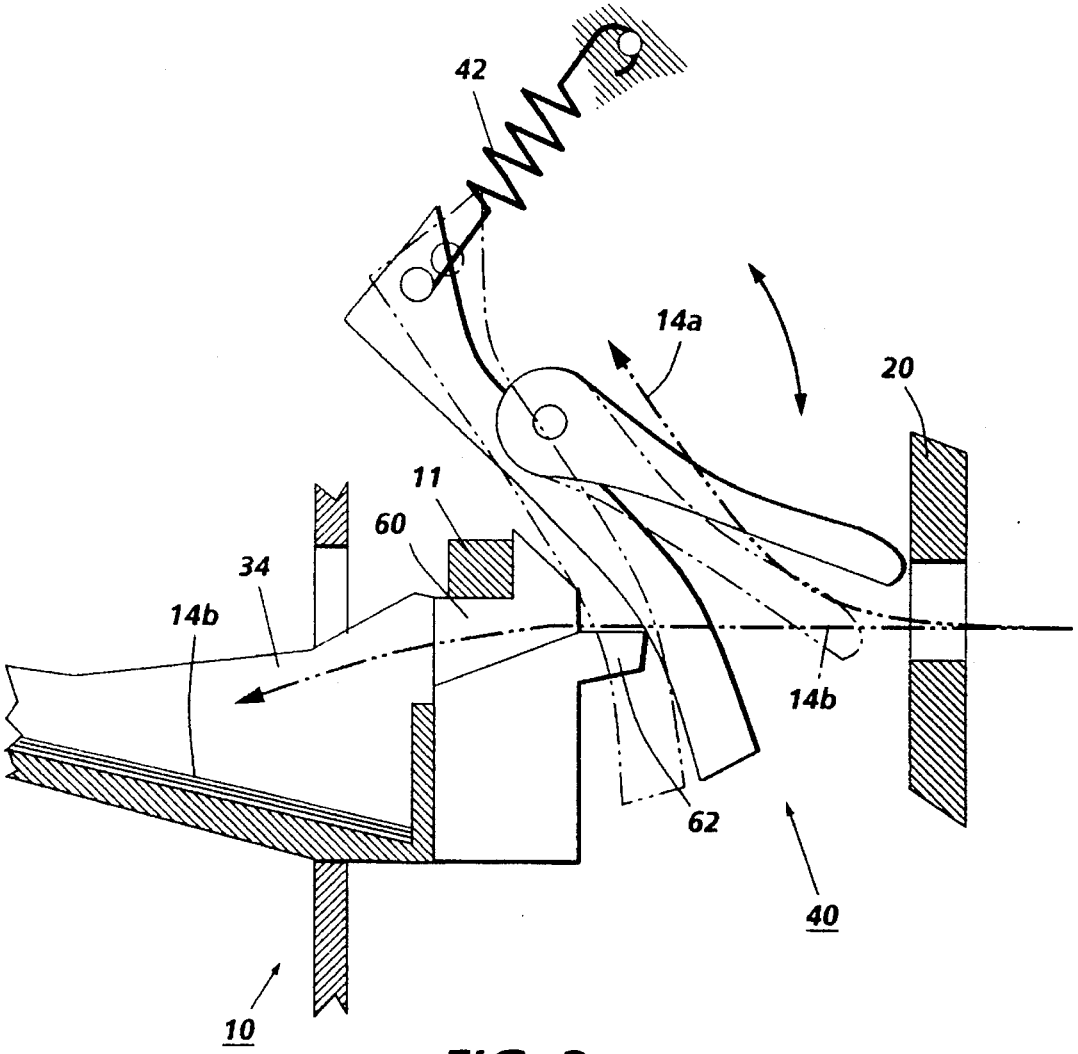
FIG. 3 is an elevational view showing the interaction of a side output tray with the diverter according to the present invention.

FIG. 3 shows a detailed view of the area around diverter 40 when the side output tray 34 is installed in the printing apparatus 10. As shown in FIG. 3, the tray generally indicated as 34 includes a hook 60 thereon which attaches to a suitable surface, side wall, or other structure such as shown as 11 within the main body of printer 10. Output tray 34, in addition to being adapted to receive sheets from output slot 20, includes a lug 62 which is preferably placed at one edge of output tray 34 out of the paper path 14*b*. A "lug" is defined as any structure disposed on output tray 34 where it may engage a surface of diverter 40 to hold diverter 40, as shown, in the second position. With the diverter 40 in the second position, a sheet emitted from output slot 20 will be caused to move under the diverter 40 and be collected in side output tray 34. In this way, the mere installation or removal of output tray 34 determines whether the diverter 40 is in the first position or the second position, and therefore determines whether a sheet emitted through output slot 20 will be diverted to the slitter 30, as in FIG. 2, or be alternately diverted away from slitter 30 and land intact in output tray 34. When the tray 34 is removed, spring 42 causes diverter 40 to return to the first position, and subsequent sheets emitted from output slot 20 will be directed over directing plate 44 and through slitter 30.

The overall design of the illustrated embodiment provides a desk-top printing machine, wherein a user has the option of slitting or not slitting output sheets, depending merely on whether the side output tray 34 is installed. By installing the side output tray 34, a user can effectively divert the paper path away from the slitter for those applications in which the slitter is not necessary. Thus, in a banking situation, the desktop printer can be in a basic mode for check printing, wherein checks may be printed and slit at various times as needed throughout the day. In situations wherein checks must be approved or originated by a central source remote from the branch, a central source elsewhere on the network can send the suitable data for creating checks as they are needed to the individual bank branch. When it is desired to bypass the slitter for a particular operation, such as to print a set of letters, the user at the bank branch merely attaches the side output tray 34, and the sheets for his particular job will not be slit.

The illustrated design is intended to place the slit checks in the top tray 32. In most typical designs of desk-top printers, the print is emitted from output slot 20 with the printed image side up. By causing the sheet to pass over directing plate 44 and onto top output tray 32 as shown, the prints accumulated in top output tray 32 (whether slit or not) will be made available with the printed side down: the passage of the sheet over the directing plate 44 has the effect of inverting each individual sheet. This face-down arrangement for the top tray 32 has a practical advantage in that, typically, sheets are accumulated in the top tray in page order. The first page in a multipage job will be emitted first, and successive pages will be emitted behind the first page in order. This arrangement is particularly useful in printing a book of starter checks, which are numbered in order. If the slitter 30 is used, what is accumulated in top tray 32 is three or four piles of checks which may be easily collated to form a single book of checks in their proper order, which may be subsequently bound by other means to form a starter checkbook.

Although the illustrated design shown accumulates slit pages in the top tray 32 and uncut pages in the side tray 34, it is certainly apparent that, should it be so desired, the placement of the slitter 30 could be provided relative to a diverter such as 40 to output cut sheets to a side output tray and uncut sheets to the top output tray.

Figure 4:
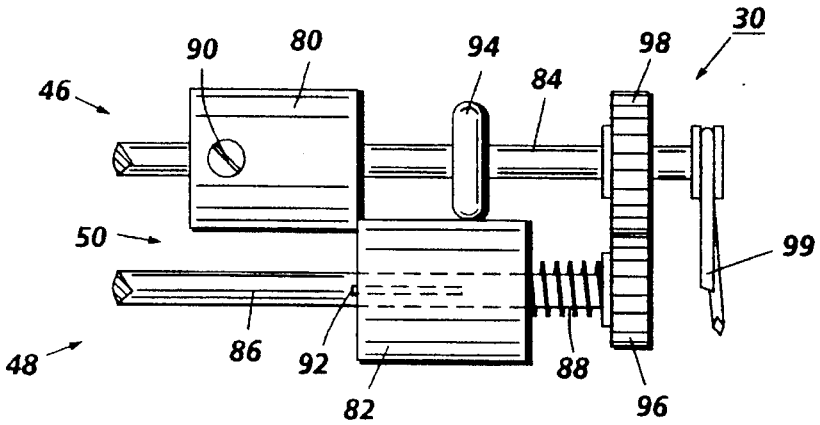
FIG. 4 is an elevational view, orthogonal to the view of FIG. 2, showing one preferred embodiment of a slitter according to the present invention.

FIG. 4 is a detailed elevational view showing the relevant parts of the slitter 30 in a preferred embodiment of the present invention. The rolls 46 and 48, which were generally indicated in FIG. 2, may include structures such as cutting cylinders 80 and 82, which are disposed along axles 84 and 86, respectively. As is known in the art, the desired slit is created at the interface at the ends of the cutting cylinders 80 and 82. One or both cutting cylinders may be urged against the end of its opposite, as cutting cylinder 82 is here urged by spring 88 against the end of cutting cylinder 80. Various cutting cylinders may be attached to the upper axle by screws such as 90, so that the position of the slits created by the rolls may be adjusted as necessary for a particular purpose; the cylinders may also be "keyed" on the inner surface thereof, such as shown by 92, to be movable along the length of the axle but rigid with respect to rotation of the axle, in a manner familiar in the art. It is also well known to include foam rubber rollers such as 94, to prevent stalling of sheets through the slitter.

According to a preferred embodiment of the present invention, both rolls 46 and 48 of the slitter 30 should be positively driven, such as by gears 96 and 98, as opposed to having one roll drive the other by mere friction along the length thereof. One or both rolls may be driven by the main drive of the printing apparatus as a whole, as can be seen, by pulley 99, which may be connected, for example, to the drive mechanism powering the fuser or photoreceptor in the main portion of the printing machine. Once again, in addition to functions such as slitting, the rolls such as 46 and 48 in slitter 30 may be further adapted to form other similar functions, such as creating perforations or even embossing and debossing of sheets passing therethrough, according to a particular need.

While the invention has been described with reference to the structure disclosed, it is not confined to the details set forth, but is intended to cover such modifications or changes as may come within the scope of the following claims.

I claim:

1. An apparatus for cutting sheets emitted in an output direction from an output slot of a printing machine, comprising:

a slitter, which receives a sheet fed therethrough in a process direction and creates a cut in the sheet parallel to the process direction;

a diverter, the diverter being positionable in a first position to direct a sheet emitted from the output slot through the slitter, and alternately positionable in a second position to direct a sheet emitted in the output direction from the output slot away from the slitter; and an output tray including a lug thereon, the lug engaging the diverter to position the diverter in the second position.

2. The apparatus of claim 1, further comprising a directing plate, directing a sheet emitted in the output direction from the output slot, and inverting the sheet as the sheet passes thereover.

3. The apparatus of claim 2, the directing plate directing sheets passing thereover to the slitter.

4. The apparatus of claim 3, further comprising a top output tray disposed downstream of the slitter in the process direction.

5. A printing machine, comprising:

an image forming device, creating an image on a sheet and outputting the sheet having the image thereon;

a slitter, adapted to receive a sheet fed therethrough in a process direction and create a cut in the sheet parallel to the process direction;

a diverter, the diverter being positionable in a first position to direct sheets from the image forming device through the slitter, and positionable in a second position to direct sheets from the image forming device away from the slitter; and an output tray including a lug thereon, the lug engaging the diverter to position the diverter in one of the first position or the second position.

6. The printing machine of claim 5, further comprising a directing plate, directing the sheet from the image forming device through the slitter, the directing plate inverting the sheet as the sheet passes thereover.

* * * * *